United States Patent [19]

Abe et al.

[11] 4,427,857

[45] Jan. 24, 1984

[54] VACUUM INTERRUPTER

[75] Inventors: Nobuo Abe, Tokaimura; Hiroyuki Sugawara, Hitachi; Yukio Kurosawa, Hitachi; Akira Wada, Hitachi; Kiyoji Iwashita, Hitachi, all of Japan

[73] Assignee: Hitachi, Ltd., Tokyo, Japan

[21] Appl. No.: 319,985

[22] Filed: Nov. 10, 1981

[30] Foreign Application Priority Data

Nov. 17, 1980 [JP] Japan ..... 55-160715

[51] Int. Cl.[3] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,935,406 | 1/1976 | Murano et al. | 200/144 B |
| 4,196,327 | 4/1980 | Kurosawa et al. | 200/144 B |
| 4,336,430 | 6/1982 | Kurosawa et al. | 200/144 B |

*Primary Examiner*—Robert S. Macon

*Attorney, Agent, or Firm*—Antonelli, Terry & Wands

[57] ABSTRACT

A vacuum interrupter of parallel magnetic field electrode type comprising a pair of separatable arc electrodes disposed within a vacuum vessel, with each being provided on its back side with a conductive rod extending outwardly of the vacuum vessel. Coil electrodes are electrically connected between the associated arc electrode and rod for applying parallel magnetic fields to arc, and slits are formed in the arc electrodes for suppressing eddy currents of the arc electrodes resulting from the parallel fields. A reinforcement member of an electric conductivity higher than a main surface portion of the arc electrode is provided on the back side of the arc electrode opposite to said main surface portion so that the resulting arc current flows uniformly through the reinforcement member so that a higher interruption efficiency can be obtained for the vacuum interrupter.

8 Claims, 7 Drawing Figures

VACUUM INTERRUPTER

The present invention relates to an improved vacuum circuit breaker or interrupter in which arc electrodes are connected to the respective coil electrodes within a vacuum vessel to generate magnetic fields parallel to one another to thereby eliminate an arc being triggered or occurring between the arc electrodes.

In prior art vacuum circuit breaker or interrupter, a pair of opposing arc electrodes are provided in a cylindrical vacuum vessel, which electrodes are each mounted on its back side with a conductive rod. Normally, in a contact or close position the pair of arc electrodes are energized with a current. In case of any troubles in the external circuit (such as an electric motor) connected to the vacuum interrupter, the vacuum interrupter functions to break or separate the pair of arc electrodes from each other to prevent the damage of the motor. In this case, an arc generated between the pair of arc electrodes must be eliminated as quickly as possible. In order to suppress or eliminate arc resulting from a large current flowing through the arc electrodes, there has been disclosed in U.S. Pat. No. 4,196,327 and in British Pat. No. 1,573,350 a vacuum interrupter of parallel magnetic field electrode type wherein axially parallel magnetic fields are applied to the generated arc so as to disperse the arc into a numerous number of thin fiber-like arc currents for elimination of the arc.

With the vacuum interrupter of such parallel magnetic-field electrode type, coil electrodes electrically connect the respective rods at the tip ends thereof with the respective arc electrodes. The coil electrodes each comprises a plurality of arm sections extending radially from the rod through which a current supplied from the rod is passed, and a circumferential ring section for passing the currents coming from the arm sections into the ring section to generate axially parallel magnetic fields. The circumferential ring section is electrically connected partly with the associated arc electrode. The arc electrode is formed with a plurality of slits which extend radially from the center of the arc electrode. The slits serve to reduce that area on the arc electrode where eddy currents induced by the parallel magnetic fields flow to thereby prevent the reduction of the magnetic fields.

In the vacuum interrupter of the type referred to above when an arc current flows radially from the surface center of the arc electrode toward the circumference thereof, current paths therebetween are long and high in electric resistance, and, consequently it is difficult for the arc current to flow equally through the current paths on the surface of the arc electrode. This prevents the enhancement of the interruption performance or function of the vacuum interrupter.

On the other hand, it has been suggested in U.S. Pat. No. 4,336,430, West Germany Patent Application No. 29,468,006 and British Patent Application No. 7,939,904, to provide a vacuum interrupter in which slits are positioned in the respective arc electrodes in such a manner that the arc current flowing through each of the arc electrodes causes axially parallel magnetic fields to be generated, to thereby obtain a higher interruption efficiency for the vacuum interrupter. However, it is still impossible to eliminate such defects as described above even with the use of this type of arc electrodes.

It is an object of the present invention to provide a vacuum interrupter which allows a uniform distribution of an arc current to the arc electrodes, thereby providing a relatively high interruption efficiency.

In order to obtain this object, the arc electrodes according to the present invention are respectively provided on a back side, i.e., the face of the arc electrode opposite to a main surface portion on which the arc takes place, with a reinforcement member of an electric conductivity higher than the main surface portion, thus allowing a substantial reduction of the electric resistance of current paths in the arc electrode between the center and circumference thereof. Therefore, the arc current can flow from the center of the arc electrode uniformly into the conductive reinforcement member attached onto the circumferential portion thereof, whereby a higher interruption efficiency can be obtained for the vacuum interrupter.

The above and other objects and advantages of the present invention will be apparent from the following detailed description in conjunction with the accompanying drawings, in which.

Figure 1:
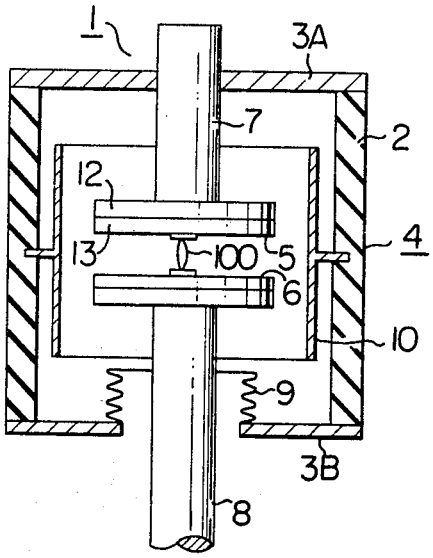
FIG. 1 is a cross-sectional side view of a vacuum interrupter according to an embodiment of the present invention.

Referring now to FIG. 1, a vacuum interrupter generally designated by the reference numeral 1 includes a vacuum vessel 4 defined by a cylindrical insulating wall 2 and metallic end caps 3A, 3B sealing the wall at the both ends thereof, and a pair of stationary and movable electrode assemblies 5, 6 disposed within the vacuum vessel in separatable and contactable fashion from and with each other, i.e. to allow ON and OFF operations. From the back sides of the electrode assemblies 5 and 6, respective conductor rods 7 and 8 are extended outwardly of the vacuum vessel 4. A metallic bellows 9 is arranged between one of the rods 8 and the related end cap 3B so that the movable electrode assembly 6 is separatable and contactable from and with the mated stationary electrode assembly 5. Between the both electrode assemblies 5 and 6 and the inner wall of the insulating cylinder 2, an intermediate metallic shield 10 is disposed.

The structures of the fixed and movable electrode assemblies 5 and 6 will be next detailed with reference to FIGS. 2 to 4. Since the both electrode assemblies 5 and 6 are the same in structure, however, only the fixed electrode assembly will be explained in the following for the brevity of the explanation.

Figure 2:
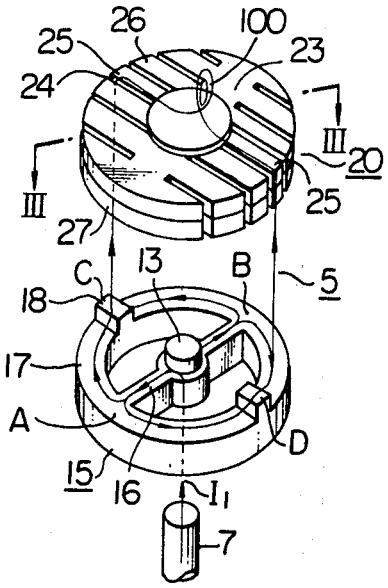
FIG. 2 is a perspective view of a stationary electrode assembly used in the vacuum interrupter of FIG. 1.
Figure 3:
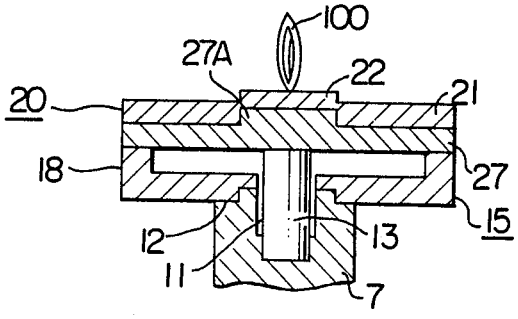
FIG. 3 is a cross-sectional view of an arc electrode in the stationary electrode assembly of the vacuum interrupter of FIG. 1 and taken along line III—III in FIG. 2, partly showing a rod mounted onto the arc electrode.
Figure 4:
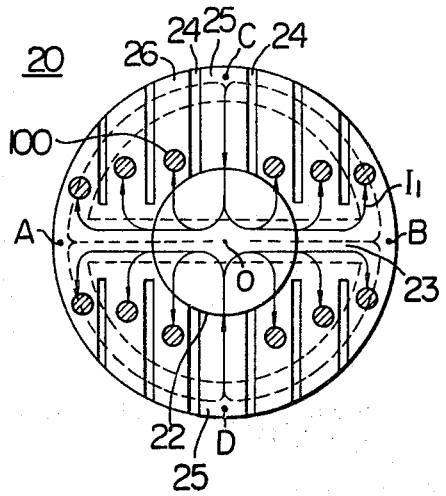
FIG. 4 is a detailed plan view of the arc electrode of FIG. 2 or FIG. 3.

Turning first to FIGS. 2 and 3, the conductive rod 7 is formed at its one end with a hollow portion 11 which receives a spacer 13 made of high electric resistance material such as stainless steel, and a stepped portion 12 which carries a coil electrode generally designated by the reference numeral 15. The coil electrode 15 is provided with integral arm sections 16 which extend radially outwardly from the rod 7, and with a circumferential ring-shaped section 17 which is connected integrally to the arm sections. The ring section 17 is also provided with a projected section 18. An arc electrode generally designated by the reference numeral 20 is supported by the projection 18 and the spacer 13.

The arc electrode 20 has a contact portion 22 at the central portion thereof and a main surface portion 21 continuously connected therewith. The contact portion 22 extends in a direction toward the opposed arc electrode of the mating electrode assembly 6. Main current paths 23 are formed on the main surface portion 21 as extended radially from the center 0 of the contact portion 22 to opposed circumferential points A and B on the coil electrode 15. A plurality of slits 24 extend from the main current paths 23 toward opposing circumferential points C and D which form right angles with respect to the points A and B, so as to define therebetween communication current paths 25 and six branching current paths 26 on the arc electrode 20. Instead of the slits 24, proper current blocking members may be provided which are made of high resistance material such as stainless steel and ceramic. The communication current paths 25 are connected at the both ends with the projections 18 and at the central portion with the contact portion 22, so that the current coming from the coil electrode 15 is passed to the arc electrode 20 or the current coming from the arc electrode 20 is passed to the coil electrode 15. The branching current paths 26 are used to branch the currents coming from the main current paths 23. The main, communication and branching current paths 23, 25 and 26 are joined with proper solder to a conductive reinforcement member 27. The reinforcement member 27 is higher in electric conductivity than the main surface portion 21 and the contact portion 22. In other words, the electric resistance of the main surface portion 21 is greater than that of the reinforcement member 27. Conductive materials suitable for the main surface and contact portions 21 and 22 include Cu-Fe alloy and Cu-Co alloy. Proper conductive materials of the reinforcement member 27 include Cu-Pb alloy and Cu-Bi alloy. The thickness $T_1$ of the reinforcement member 27 is greater than the thickness $T_2$ of the main surface portion 21 ($T_1 > T_2$).

Figure 5:
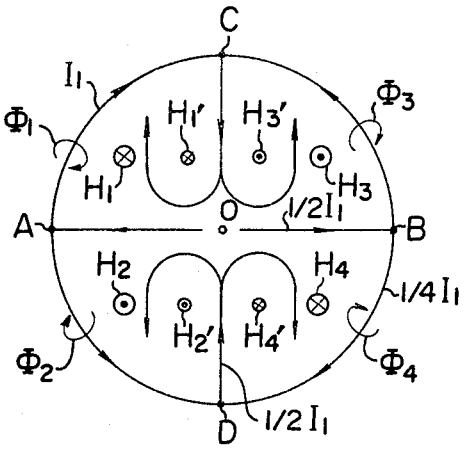
FIG. 5 is a schematic diagram for explanation of current paths flowing through the stationary electrode assembly of FIG. 2.

The operation of the arc electrode 20 will be next detailed with reference to FIGS. 2 and 5. In the coil electrode 15, a current $I_1$ entering into the coil electrode 15 from the rod 7 is first divided by the arm sections 16 equally into currents of $\frac{1}{2}$ $I_1$ in opposite radial directions OA and OB, which divided currents of $\frac{1}{2}$ $I_1$ are each further divided at points A and B by the ring section 17 into currents of $\frac{1}{4}$ $I_1$ in circumferential directions, which currents of $\frac{1}{4}$ $I_1$ are combined at points C and D respectively into currents of $\frac{1}{2}$ $I_1$ to thus flow through the communication current path 25. In this way, when the different currents in opposing directions to each other will flow through the ring section 17, magnetic fluxes $\Phi_1$, $\Phi_2$, $\Phi_3$ and $\Phi_4$ are induced, and the induced fluxes will cause magnetic fields $H_1$, $H_2$, $H_3$ and $H_4$ to generate in the arc electrode 20. The magnetic fields $H_1$ to $H_4$ are parallel to one another and cancelled out to each other at the center 0 of the arc electrode 20 with respect to fields $H_1$ and $H_3$, and $H_2$ and $H_4$. The current $I_1$ will pass through contact portion 22 from the respective communication current paths 25.

As soon as the movable electrode assembly 6 is separated from the stationary electrode asssembly 5, arc 100 will take place on the contact portion 22. When the arc 100 is subjected to the parallel magnetic fields $H_1$ to $H_4$ and parallel magnetic fields $H'_1$ to $H'_4$ as will be explained later, the arc 100 will be dispersed into a numerous stream of arc currents $I_2$, as shown in FIG. 4. The arc currents $I_2$ will flow from the contact portion 22 to the conductive reinforcement member 27 via the current paths 23, 25 and 26. In this connection, the arc currents $I_2$ will follow the similar route to the current $I_1$, as illustrated in FIG. 5. Therefore, the arc currents $I_2$ will produce in the arc electrode 20 the parallel and same directioned magnetic fields $H'_1$ to $H'_4$ as in the coil electrode 15. If these four magnetic fields $H'_1$ to $H'_4$ are equal in the strength, then the arc current $I_2$ will pass equally through the paths 23, 25 and 26, which results in an enhanced interruption performance without any local heating. In order to flow the arc current $I_2$ equally through the paths 23, 25 and 26, the conductive reinforcement member 27 is provided in this embodiment of the present invention.

More specifically, the arc current $I_2$ from the contact portion 22 will flow through the conductive reinforcement member 27. The reinforcement member 27 has an electric conductivity better than the main surface portion 21 in this embodiment such that the electric resistance of the current paths 23, 25 and 26 between the center 0 and the circumferential points A to D is smaller than that of the main surface portion 21. This will cause the arc current $I_2$ to flow equally through branching paths 26 from the main current paths 23, so that a high interruption efficiency can be obtained without the generation of local heat.

When current flows through the arc electrode 20, heat will be generated, in particular, in the contact portion 22 and the communication current paths 25. The generated heat reaches the conductive reinforcement 27 from the contact portion 22, and further transmitted from the reinforcement member 27 via the coil electrode 15 to the rod 7 for cooling. This will enable the temperature increase of the contact portion 22 and communication current paths 25 to be reduced. Therefore, the main surface portion 21 and contact portion 22 can pass a large current therethrough without being melted. In this connection, by providing an embossment 27A on the conductive reinforcement member 27 so as to fit into the contact portion 22 or by maintaining the relationship $T_1 > T_2$, additional cooling effect can be obtained, since the current $I_1$ and the arc current $I_2$ can flow promptly through the conductive reinforcement member 27.

Figure 6:
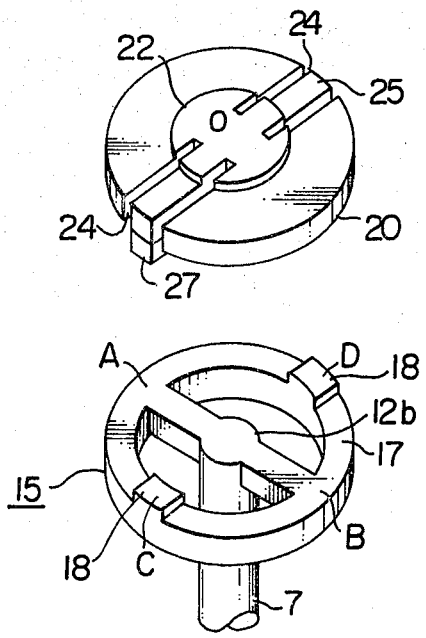
FIG. 6 is a perspective view of an arc-electrode and associated coil electrode of another embodiment of the present invention.

Further, heat generated in energization of the electrode assemblies may be eliminated or cooled by applying the reinforcement member 27 onto the communication current paths 25 alone as shown in FIG. 6.

Figure 7:
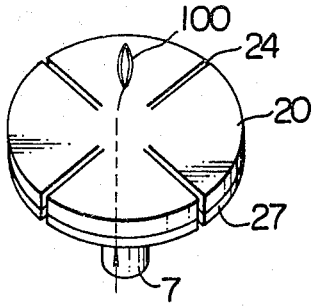
FIG. 7 is a perspective view of an arc electrode of a further embodiment of the present invention.

Although explanation has been made in the case where the arc electrode 20 and coil electrode 15 generate magnetic fields parallel to one another (parallel magnetic field electrode type) in the above embodiment, it goes without saying that heat generated in energization may be also cooled in the similar way to the above, by using such an arc electrode 20 as shown in FIG. 7 for a coil electrode (not shown) which produces parallel magnetic fields not cancelled out to each other at the center of the electrode assembly and by attaching the conductive reinforcement member 27 onto the back side of the arc electrode 20. In addition, such an arc electrode 20 as prevents any excessive current may be employed by making the arc electrode 20 itself thinner to increase the electric resistance thereof.

As has been described above, the interruption function of the vacuum interrupter according to the present invention can be remarkably improved by employing the conductive reinforcement member 27 having a better electric conductivity than the main surface portion 21 of the arc electrode 20.

While the present invention has been explained with reference to the preferred embodiments shown in the drawings, it should be understood that the invention is not limited to those embodiments but covers all other possible modifications, alternatives and equivalent arrangements included in the scope of the appended claims.

What is claimed is:

1. A vacuum interrupter comprising a pair of separable arc electrodes disposed within a vacuum vessel in such a manner that main surfaces of said arc electrodes are opposed to each other, each of said arc electrodes are provided on a back side opposite to the main surface with a rod extending outwardly of said vacuum vessel, coil electrode means provided on at least one side of each of said arc electrodes for generating and applying to an arc magnetic fields which are in parallel with the arc generated on said arc electrode, and current blocking means selectively provided on each of said arc electrodes for suppressing eddy currents generated by said magnetic fields, wherein said vacuum interrupter further includes a reinforcement member of an electric conductivity higher than that of the main surface of said arc electrode, said reinforcement member being provided on the back side of each of said electrodes except in areas of said current blocking means.

2. A vacuum interrupter according to claim 1, wherein a thickness of said conductive reinforcement member is greater than a thickness of said main surface portion of said arc electrode.

3. A vacuum interrupter according to claim 1 or 2, wherein each of said arc electrodes is provided at a center of the main surface thereof with a contact portion projecting from said main surface thereof.

4. A vacuum interrupter comprising a pair of separable arc electrodes disposed within a vacuum vessel in such a manner that main surfaces of said arc electrodes are opposed to each other, each of said arc electrodes is provided on a back side opposite to the main surface with a rod extending outwardly of said vacuum vessel, coil electrode means provided on at least one side of each of said arc electrodes for generating and applying to an arc parallel magnetic fields which are in parallel with the arc generated on said arc electrode, and current blocking means selectively provided on each of said arc electrodes for suppressing eddy currents generated by said magnetic fields, wherein each of said arc electrodes is electrically connected with said coil electrode so that the parallel magnetic fields generated in the coil electrode cancel out each other at a central axis of said rod; each of said arc electrodes comprising:

main current paths formed in the arc electrode and extending in radial and opposite directions from the center thereof;

said current blocking means including a plurality of current blocking portions formed between said main current paths and the circumferential portion of said arc electrode;

a plurality of branching current paths defined by said current blocking portions, circumferential portion and main current paths;

communication current paths included in said branching current paths through which the main current paths are electrically connected with the associated coil electrode; and a reinforcement member of an electric conductivity higher than that of the main surface portion of the arc electrode, said reinforcement member being mounted on a back side of the arc electrode opposite to said main surface provided thereon with said main, branching and communication current paths.

5. A vacuum interrupter according to claim 4, wherein said reinforcement member is attached only onto said communication current paths.

6. A vacuum interrupter according to claim 4 or 5, wherein a thickness of said reinforcement member is greater than a thickness of said main surface portion of said arc electrode.

7. A vacuum interrupter according to any one of claims 4 to 6, wherein each of said arc electrodes is provided at a center with a contact portion projecting from said main surface portion thereof.

8. A vacuum interrupter according to any one of claims 1 to 6, wherein said reinforcement member is formed on the side of said contact portion with an projected portion.

* * * * *